United States Patent [19]

Moller et al.

[11] 4,151,771

[45] May 1, 1979

[54] STOCK FEED FOR LIGHT GAUGE, SOFT TEMPERED METAL

[75] Inventors: Jens L. Moller, Darien; Carl F. Morris, Riverdale, both of Ill.

[73] Assignee: The Continental Group, Inc., New York, N.Y.

[21] Appl. No.: 835,862

[22] Filed: Sep. 23, 1977

[51] Int. Cl.[2] ..... B26D 5/20

[52] U.S. Cl. ..... 83/277; 226/151; 226/161; 226/167

[58] Field of Search ..... 226/141, 161, 158, 162, 226/165, 166, 167, 147, 151; 352/194, 195; 83/277

[56] References Cited

U.S. PATENT DOCUMENTS

| | | | |
|---|---|---|---|
| 1,341,184 | 5/1920 | Leumann | 226/165 X |
| 1,693,728 | 12/1928 | Rainsford | 226/167 |
| 3,052,392 | 9/1962 | Vogt | 226/165 |
| 3,128,028 | 4/1964 | Crafford | 226/165 |
| 3,148,817 | 9/1964 | Lord | 226/167 X |
| 3,997,254 | 12/1976 | Yamada | 352/194 |

*Primary Examiner*—Richard A. Schacher
*Attorney, Agent, or Firm*—Charles E. Brown

[57] ABSTRACT

This relates to the handling of thin soft temper material during the feeding thereof and in formation of such material into individual components in a punch press. Most particularly, a pull tab formed of a plastics material-aluminum foil laminate is being formed. In order to control the movement of the stock through the punch press, the stock is longitudinally stiffened by the formation of longitudinal ribs therein. The ribs are preferably formed by the stock feeding mechanism. The work product is blanked and formed substantially in its entirety in regions of the stock outside of the stiffening rib areas and prior to the final severing of the work product from the stock, the stiffening ribs are flattened. In the separation of the work product from the stock, there is material removal in a punching operation along the areas previously containing the stiffening ribs. Feeding of the stock is accomplished by a rotary cam which permits feeding of the stock at all times while the punch elements are disengaged from the stock, thus providing for a longer feed time. The feed may be selectively less than that provided by the cam by utilizing pivotally mounted feed dogs and a stop which effects pivoting of the dogs and the releasing of the stock while the feed mechanism is still advancing.

8 Claims, 9 Drawing Figures

15° LOW DWELL
120° RISE
15° HIGH DWELL
210° FALL $R_1$
$R_2$
$R_2$

STOCK FEED FOR LIGHT GAUGE, SOFT TEMPERED METAL

This invention relates, in general, to use and useful improvements in the punch press art, and more particularly to the formation of work elements from soft temper materials such as plastic materials-metal foil laminates and very thin metal normally of the foil thickness.

Very soft temper material, particularly thin material, is difficult to feed and handle in punch presses due to the lack of stiffness of the stock. It is proposed to provide the stock with at least one longitudinal stiffening rib, which rib is retained in the stock during a majority of the blanking and forming operations of the press with the blanking and forming operations being performed in areas of the stock outside of the rib. The stock is then flattened in the rib area followed by a final severence of the work produce from the stock by material removal in the rib area.

It is also proposed to provide a feed for a punch press which will permit a greater feed time than is normally possible with punch presses wherein the feed mechanism is actuated by a reciprocating press member. It is proposed to provide a rotary cam which is utilized as the driving element for the feed means of the press, the rotary cam being driven in unison with the rotary drive of the press and permits the feeding of stock at all times when the stock is not engaged by punch elements of the press, thus permitting feeding during a greater interval than normally is permitted. This greater time for feeding also permits acceleration ramps in the feeding so as to restrict abruptness of stock movement.

Another feature of the apparatus is that the feed mechanism includes means for gripping the stock which are in the form of die members so that during the gripping of the stock the desired longitudinally extending stiffening rib or ribs are automatically formed in the stock.

Another feature of the apparatus is that the feed mechanism includes feed dogs for clamping the stock during the feeding thereof and the effective stroke of the feeding is selectively varied by pivotally mounting the feed dogs for movement to stock releasing positions and there being an adjustable stop for automatically pivoting the feed dogs to release the stock after a predetermined stroke of the feed mechanism, the stroke of the feed mechanism being greater than that wherein the feed dogs release the stock.

Another feature of the apparatus is that the stock is gripped by a paul tooth after the feeding thereof, which is located between the feed dogs and the die and thereby providing for automatic clamping and releasing of the stock.

A further feature of the invention is the provision of apparatus and method for forming pull tabs or tear tabs for easy opening containers wherein the tear tabs are formed of soft temper material, normally a laminate of plastics material and aluminum foil and wherein control over this soft temper stock is readily maintained at all times during the blanking and forming of the individual pull tabs from the stock.

With the above and other objects in view that will hereinafter appear, the nature of the invention will be more clearly understood by reference to the following detailed description, the appended claims, and the several views illustrated in the accompanying drawings.

Figures 1, 2, 3, 7, 9:
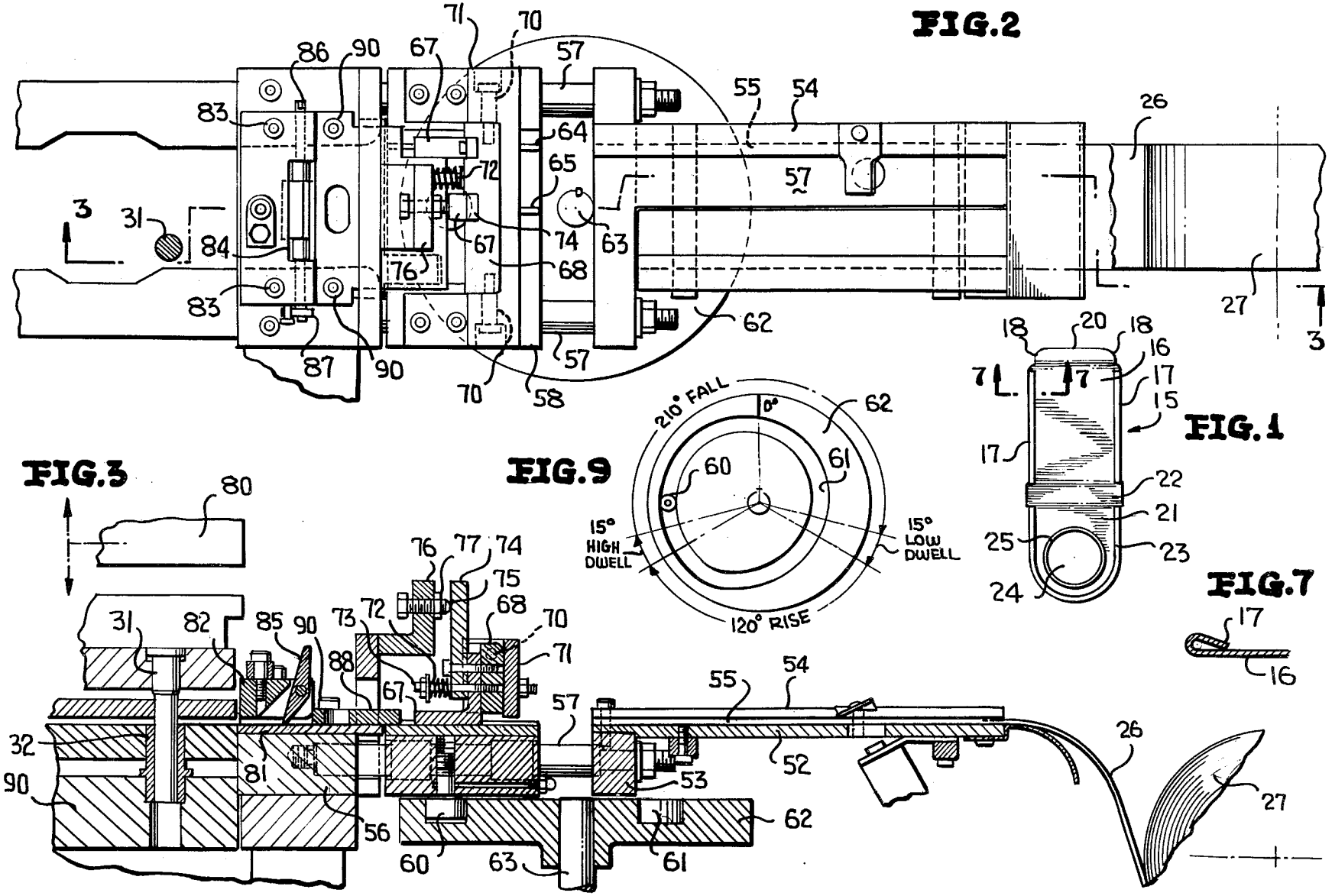
FIG. 1 is a top plan view of a pull tab formed in accordance with this invention.
FIG. 2 is a top plan view of the feed apparatus for a continuous strip, the forming and blanking dies being omitted for purposes of clarity.
FIG. 3 is a longitudinal vertical sectional view of the feed apparatus of FIG. 2 taken generally through the center thereof.
FIG. 7 is an enlarged fragmentary transverse sectional view taken along the line 7—7 of FIG. 1 and shows the edge construction of the pull tab.
FIG. 9 is a schematic plan view showing the cam contour in timed relation to the press movement.

Referring now to the drawings in detail, reference is first made to FIG. 1 wherein there is illustrated a pull tab or tear tab, generally identified by the numeral 15. The tear tab is intended to be bonded to an upper surface of an end unit of an easy opening container, which end unit may have preformed therein a suitable dispensing opening or plural dispensing openings. The pull tab 15 is formed of thin soft temper material so that it may readily progressively bend and thus be peeled from the end unit to which it is secured. Primarily, the pull tab will be formed of a plastics material-metal foil laminate, but it is reasonable that a soft metal having a very low temper may be utilized. A typical laminate would be an 0.004 inch polypropylene layer laminated to an aluminum foil.

Referring particularly once again to FIG. 1, it will be seen that the pull tab 15 includes a body portion 16 which is reinforced along the opposing side edges thereof by reversely bent hems or flanges. The body portion 16 is planar and is provided with rounded corners 18 at a free end thereof. It is to be understood that the body portion 16 will overlie and be directly secured to the end unit which is to be sealed thereby.

The pull tab 15 also includes a handle portion 21 which is connected to the body portion 16 by an intermediate portion 22. The handle portion 21 is peripherally reinforced by a reversely bent hem or flange 23. In addition, the handle portion 21 has formed therein a finger hole 24 which is founded by and reinforced by an outwardly turned hem or flange 25.

Figures 4, 5, 6, 8:
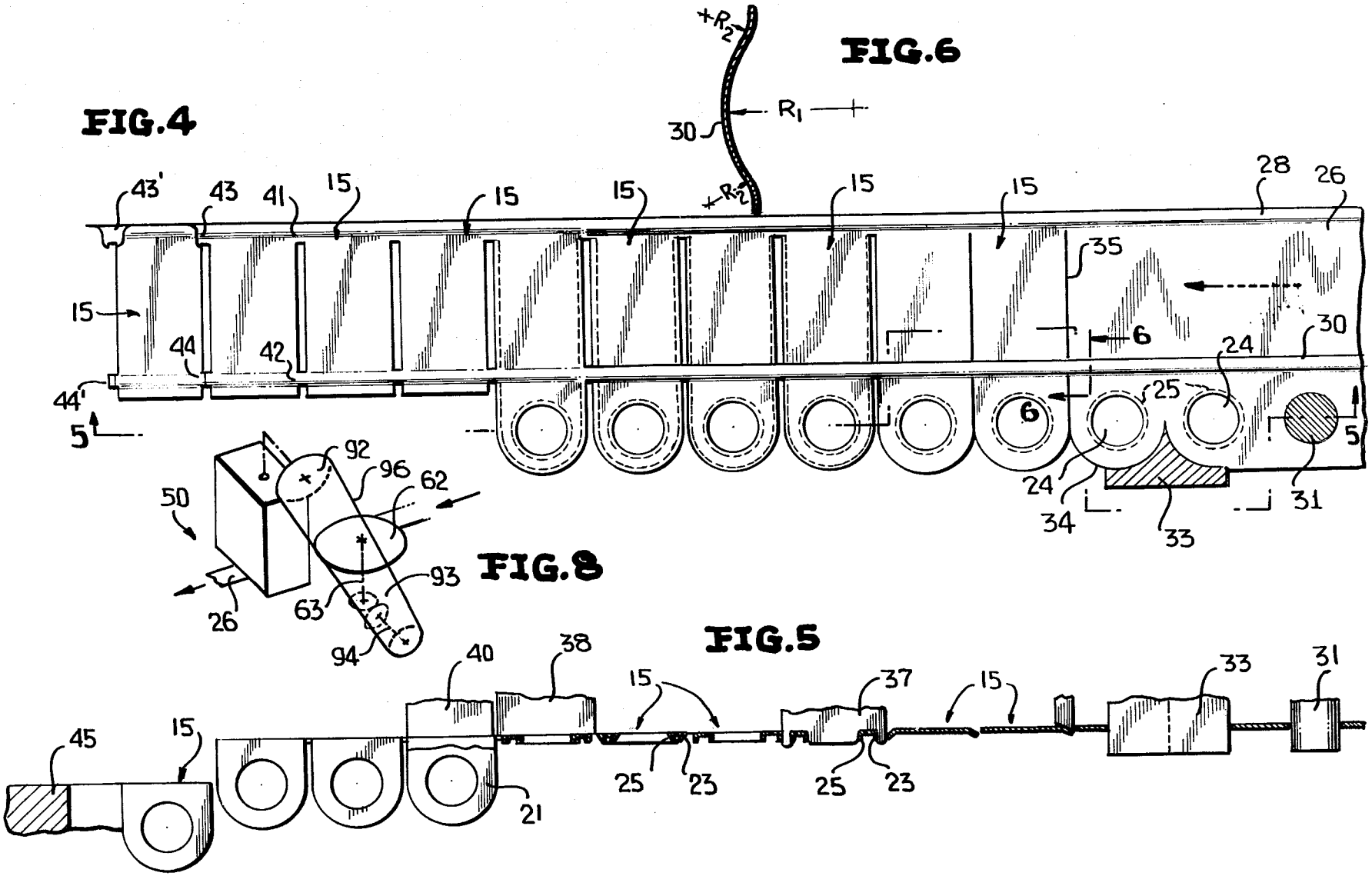
FIG. 4 is a schematic view in plan showing the sequence of forming the pull tabs of FIG. 1 from a continuous strip.
FIG. 5 is a vertical sectional view taken generally along the line 5—5 of FIG. 4 and shows further the blanking and forming operations.
FIG. 6 is an enlarged fragmentary transverse sectional view taken along the line 6—6 of FIG. 4 and shows the cross-section of a stiffening rib formed in the stock.
FIG. 8 is a schematic perspective view showing the inter-connection of the press drive and the stock drive.

It is to be understood that when one forms a pull tab or like element from a continuous strip of low temper material such as that described above, control over the stock has proved to be difficult because of the lack of rigidity or structural strength of the stock. To this end, it is proposed to stiffen stock from which the pull tabs 15 are formed. The stock is identified by the numeral 26 (FIG. 4) and is supplied in the form of a coil 27. As is best shown in FIG. 4, prior to any blanking or forming operation thereon, the stock 26 is provided with a first upstanding rib 28 along one edge thereof and a second upstanding rib 30 intermediate the edges thereof and in a position to be aligned with the intermediate portion 22 of the pull tab 15. Referring now to FIG. 6 in particular which shows the details of a typical rib, the radius R1 may be on the order of 0.078 inch while each radius R2 will be on the order of 0.030 inch. The total height or crowning of the rib will be on the order of 0.026 inch. The total width of the rib will be on the order of 0.2 inch while the width of the primary crown portion will be on the order of 0.12 inch.

As previously described, the pull tab 15 will be provided with a finger opening 24 and this is initially defined by a punch 31 which will cooperate with a suitable die 32, as shown in FIG. 3. Next, in a simple forming operation, the metal around the opening formed by the punch 31 will be downwardly flanged to define the flange 25 in a downwardly directed position. Following forming of the flange 25 at the second stage, the edge of the stock 26 will be blanked by means of a blanking punch 33 so as to place a rounded end on the stock 26 for each pull tab to be formed. This rounded edge 34 will be concentric to the hole 24.

Next, the stock 26 will be transversely slit along lines 35 and 36, the line 35 extending between the ribs 28 and 30 and the line 36 extending from the rib 30 to the adjacent edge of the stock 26, the line 36 forming a continuation of the rounded edge 34 of two adjacent tear strips 15. The individual pull tabs 15 are now defined.

At a further station, the stock 26 is engaged by a forming die 37 which engages the upper edges of the pull tab blank defined by the cut lines 35 and 36 and the founded edge 34 so as downwardly to deform the peripheral edge of the tab blank to initiate the forming of the hem or flanges 17 and 23.

At yet another station, all of the flanges 17, 23 and 25 are folded inwardly to a generally 45° position. This station is identified by the letter X. Finally, a flattening die 38 is utilized simultaneously to flatten the flanges or hems 17, 23 and 25. The flattening die also flattens the ribs 28 and 30.

Next, a bending die 40 is utilized to bend the handle portion 21 downwardly generally at right angles to the body portion 16 along the line spaced slightly from that portion of the rib in which the rib 30 was formed.

It is to be noted that adjacent pull tabs 15 are now completely separated from one another and are completely formed except for material at 41 and 42 along the portions previously occupied by the now flattened ribs 28, 30. In a final blanking operation. The blanking punch cuts the tab 15 loose from the strip 26 at 43 and 44, leaving two small pieces of scrap 43' and 44'. Then the blanking punch cuts the scrap 43' and 44' off and deposits the tab on a transfer dial 45 in the assembly press which is utilized to deliver the completed and bent pull tab to an end unit for sealing thereto in a conventional manner.

Reference is now made to FIGS. 2 and 3, wherein there is illustrated specific details of a press mechanism, generally identified by the numeral 50. The press mechanism 50 includes a feed mechanism generally identified by the numeral 51. The feed mechanism 51 includes a support 52 carried by a support 53 for receiving stock 26 from the coil 27. The support 52 together with an associated overlying and spaced guide 54 defines a guideway 55 for advancing stock.

The press 50 also includes a fixed support 56 located remote from the support 52. A pair of guide rods 57 extend between and are fixedly secured to the supports 53, 56.

A feed member 58 is mounted on the guide rods 57 for reciprocal movement toward and away from the support 56 and the remainder of the press assembly 50. The feed member 58 carries on the underside thereof a cam follower 60 which is seated in a cam track 61 of a rotary cam 62. The cam 62 is carried by and driven by a shaft 63. It is to be understood that as the cam rotates the feed member 58 reciprocates back and forth on the guide rods 57 in timed relation to the operation of the remainder of the press in a manner to be described in more detail hereinafter.

The feed member 58 is provided on the upper surface thereof with two longitudinally extending ribs 64, 65 which correspond to the positions of the ribs 28, 30. Stock 26 advancing into overlying relation to the ribs 64, 65 and the feed member 58 is transversely aligned by guide elements 66 forming part of the support 52.

In order to effect gripping of the stock 26 overlying edge of the ribs 64, 65 is a dog 67 which has the underside thereof contoured to conform to and cooperate with the ribs 64, 65 and thus form the stiffening ribs 28 and 30 in the stock 26. The dogs 67 are carried by a carrier 68 which is pivotally mounted on transverse shafts 70 in turn supported by a support member 71 which is fixedly secured to the feed member 58. The support 71 is generally U-shaped in elevation to provide clearance for the stock 26 and is further generally U-shaped in plan to receive the carrier 68. The carrier 68 is constantly urged into engagement with the support 71 as shown in FIG. 3 by means of a spring 72 which bears thereagainst and is carried by a rod 73 projecting to the left from the support 71 and extending through the carrier 68. In this position of the carrier 68, the dogs 67 are in stock clamping relation with respect to the ribs 64, 65. It is also to be understood that the spring 72 applies sufficient force to the carrier 68 to effect a forming of the stock 26. In order words, the dogs 67 and the associated ribs 64, 65 function as die members under the influence of the spring 72 to pressure shape the stock 26 and thus form the ribs 28, 30. It is to be noted that the ribs 64, 65 are considerably longer than the width of a tab 15 and while the dogs 67 are not as long as the ribs 64, 65, they are also longer than the width of a tab 15 so that at each forming of the ribs 28, 30 there is a partially formed portion of each rib 28, 30 interlocked with its underlying ribs 64, 65 and thus alignment of newly formed rib portions with the previously formed portions of the ribs 28, 30 is assured.

At this time it is pointed out that after the stock 26 has been fed a preselected distance, the dogs 67 are automatically elevated so as to release the stock. This is effected by pivoting the carrier 68 in a clockwise direction by means of a lever 74 projecting up above the carrier 68 and being engageable with a stop screw 75. The stop screw 75 is carried by a suitable fixed support 76 and is adjustable. It is to be noted that the screw 75 is threaded through the support 76. A lock nut 77 retains the adjusted position of the screw 75.

At this time it is pointed out that the stroke of the feed member 58 is in excess of the width of a tab 15 so that it is capable of feeding the stock 26 a distance in excess of that required for the formation of the tabs 15. The proper feeding of the stock is controlled by the adjustment of the stop screw 75.

It is to be understood that the press assembly 50 further includes an upper platen 80 which is mounted for vertical reciprocatory movement in the conventional manner. The platen 80 carries the various upper punches and dies generally described with respect to the forming of the pull tab 15 in FIGS. 4 and 5. The press also includes a lower platen 90 which is generally fixed but which carries dies, such as the die 32, and suitable anvils, which may be spring loaded, for cooperation with the various blanking and forming punches carried by the upper platen 80. Since the specific tooling of the press apparatus is not part per se of this invention, no effort is made here to describe the tooling in more detail.

Carried by the block 56 in overlying relation thereto is a wear plate 81. Overlying the wear plate 81 and having a central portion spaced therefrom is a guide block 82 which is secured to the block 58 by suitable fasteners 83. The guide plug 82 has a right central portion thereof formed with a notch 84 in which there is positioned a pawl tooth 85. The pawl tooth 85 is carried by a pin 86 which is rotatably journalled in the guide block 82 on opposite sides of the notch 84. It is to be understood that the pawl tooth is fixedly secured to the pin 86 for rotation therewith.

One end of the pin 86 has connected thereto a coil spring 87 which is carried by the guide block 82. The coil spring 87 constantly urges the pin 86 and the pawl tooth 85 to rotate in a counterclockwise direction so that the pawl tooth is always urged toward the wearplate 81. Thus when the sheet stock 26 is positioned between the pawl tooth 85 and the wearplate 81 toward the die set, the pawl tooth 85 will rotate in a clockwise direction against the resistance of the coil spring 87 and lift relative to the stock 26 so as to permit the advancement of the stock. When the feed fingers 67 retract, the pawl tooth 85 will engage the upper surface of the stock 26 and prevent pullback thereof.

It is also to be noted that the block 56 carries a retainer 88 which overlies the wearplate 81 to the right of the pawl tooth 85 for guiding the stock into underlying relation with respect to the pawl tooth 85 and the guide block 82. The retainer 88 is in the form of a flat plate which is held in place by suitable fasteners 90 which extend through the wearplate 81 into the block 56.

Reference is now made to the diagrammatic showing of FIG. 8 wherein the drive for the press apparatus 50 and the cam 62 is illustrated. The press apparatus 50 includes a main shaft 92 through which vertical reciprocation of the upper platen 80 is effected. The shaft 63 of the cam 62 may be part of a right angle drive 93 which includes an input shaft 94. A suitable drive 96 of the sprocket and chain type connects together the shafts 92, 94 for effecting the rotation of the cam 62 in timed relation to the reciprocation of the platen 80.

Thus, by properly orienting the cam 62 with respect to the shaft 92, the feed apparatus 51 may be so actuated that as soon as the punch and die elements carried by the platen 80 are moved out of restraining engagement with respect to the partially formed stock, feeding of the stock may be effected and this feeding may be accurately timed so that the feeding is discontinued just prior to the moment at which the punches and dies carried by the platen 80 engage the stock.

Reference is now made to FIG. 9 wherein there is illustrated the general details of the cam 62. It is to be noted that the cam track 61 is so configurated and the cam 62 is so timed with respect to the press mechanism that there is a dwell of the cam between 120° and 105° and that there is stock feed between 10—° and 255° followed by a high dwell between 255° and 240°. The cam then causes return of the cam follower and the associated feed mechanism between 240° and the beginning of the load dwell of 120°. It is to be understood that the die components of the press are engaged with the stock generally between 135° and 225° at which time the cam follower and the feed mechanism are being returned to their starting positions.

It is to be understood that the configuration of the cam track 61 is such that proper acceleration ramps are provided so as to maintain acceleration forces within required limits.

It is particularly pointed out here with the specific driving of the feed apparatus by a cam and cam follower which is driven in unison with the operation of the press apparatus, more time than usual is provided for the feeding of the stock. Further, ample time is provided for the retraction of the feed mechanism to its starting position while the punches pass into and through the stock and then are withdrawn. In FIG. 9 there is illustrated schematically the movements of the cam follower 60 with respect to a reference point. It will be readily apparent that utilizing a cam and cam follower, acceleration and deceleration of the movement of the feed mechanism may be readily selected and controlled. It is to be understood that the schematic showing of cam follower movements is only intended to be typical and not that expressly preferred with reference to the illustrated pull tab 15.

Although only a preferred embodiment of the invention has been specifically illustrated and described herein, it is to be understood that minor variations may be made in the structure of the press mechanism, the feed mechanism therefor and the tooling without departing from the spirit and scope of the invention as defined by the appended claims.

What is claimed as new:

1. A sheet feed mechanism for a reciprocating press, said feed mechanism comprising a feed member, means mounting said feed member for straight line reciprocal movement for moving a sheet along a straight line path in a plane, a rotary cam lying in a plane disposed parallel to the plane of said path, and a cam follower directly carried by said feed member and engaging said rotary cam for effecting reciprocation of said feed member in response to rotation of said cam, said cam having an axis of rotation which intersects said path, said feed mechanism being coupled to the reciprocating press, said reciprocating press having a rotary drive, and drive means coupling said rotary cam to said rotary drive for rotating said cam in timed relation to the operation of said press.

2. The feed mechanism of claim 1 wherein said rotary drive is of the continuously operating type and said cam is continuously rotated.

3. The feed mechanism of claim 2 wherein said rotary cam is of a configuration to effect feeding of stock to said reciprocating press during both retracting and operating movements of said press.

4. The feed mechanism of claim 2 wherein said cam has an acceleration ramp for effecting acceleration of said feed member.

5. A sheet feed mechanism for a reciprocating press, said feed mechanism comprising a feed member, means mounting said feed member for straight line reciprocal movement, a rotary cam, and a cam follower carried by said feed member and engaging said rotary cam for effecting reciprocation of said feed member in response to rotation of said cam, said feed member including a base and at least one feed dog, means pivotally mounting said feed dog for movement both with said base and relative to said base between a stock clamping position and a stock releasing position, and a stationary stop engageable by said feed dog for moving said feed dog to said stock releasing position thereto to discontinue the feeding of stock by said feed member while said feed member continues to advance.

6. The feed mechanism of claim 5 wherein said stationary stop has mounting means for adjusting the position thereof and thereby adjusting the distance of stock feed.

7. The feed mechanism of claim 5 wherein said cam is configurated to move said base a distance in excess of the intended distance of stock feed.

8. The feed mechanism of claim 5 wherein said base and said feed dog include cooperating rib and groove portions extending in the direction of reciprocation of said feed member for progressively forming a stiffening rib in stock being fed during each feeding of the stock.

* * * * *